US009905908B2

(12) United States Patent
Tang et al.

(10) Patent No.: US 9,905,908 B2
(45) Date of Patent: Feb. 27, 2018

(54) ANTENNA STRUCTURE WITH PROXIMITY SENSOR

(71) Applicant: LUXSHARE-ICT CO., LTD., Taipei (TW)

(72) Inventors: Ching Chung Tang, Taoyuan County (TW); Sheng Hsin Chang, Kaohsiung (TW)

(73) Assignee: LUXSHARE PRECISION INDUSTRY CO., LTD., Shenzhen, Guangdong Province (CN)

( * ) Notice: Subject to any disclaimer, the term of this patent is extended or adjusted under 35 U.S.C. 154(b) by 226 days.

(21) Appl. No.: 14/154,858

(22) Filed: Jan. 14, 2014

(65) Prior Publication Data

US 2015/0200447 A1 Jul. 16, 2015

(51) Int. Cl.

| | |
|---|---|
| ***H01Q 1/44*** | (2006.01) |
| ***H01Q 5/00*** | (2015.01) |
| ***H01Q 1/24*** | (2006.01) |
| ***H01Q 5/371*** | (2015.01) |
| ***H01Q 5/378*** | (2015.01) |

(52) U.S. Cl.

CPC ..... *H01Q 1/243* (2013.01); *H01Q 1/44* (2013.01); *H01Q 5/371* (2015.01); *H01Q 5/378* (2015.01)

(58) Field of Classification Search

CPC ..... H01Q 1/44; H01Q 1/2258; H01Q 1/2266; H01Q 1/2291; H01Q 1/24; H01Q 1/241; H01Q 1/242; H01Q 1/243; H01Q 5/307; H01Q 5/342; H01Q 5/357; H01Q 5/364; H01Q 5/371; H01Q 5/378; H01Q 5/392

USPC ..... 343/720

See application file for complete search history.

(56) References Cited

U.S. PATENT DOCUMENTS

| | | | | |
|---|---|---|---|---|
| 8,649,833 | B1 * | 2/2014 | Lee | H01Q 5/335 455/575.7 |
| 8,686,297 | B2 * | 4/2014 | Shiu | H05K 1/028 174/250 |

* cited by examiner

*Primary Examiner* — Tho G Phan
*Assistant Examiner* — Patrick Holecek
(74) *Attorney, Agent, or Firm* — Cheng-Ju Chiang

(57) ABSTRACT

An antenna structure includes a dielectric layer, on one side thereof a patterned conductive layer, a proximity sensor and a capacitor are provided. The patterned conductive layer includes a first and a second conductive layer that together form a coupled-fed antenna and respectively have a first and a second feed terminal connected to a signal feed line and a ground signal line. The proximity sensor includes a peripheral circuit connected to the second feed terminal, and a capacitance to digital circuit. The capacitor is connected between the ground signal line and the second feed terminal. By integrating the coupled-fed antenna and the proximity sensor on one circuit substrate, a part of the antenna can be used as the proximity sensor's capacitor electrode to reduce the volume and manufacturing cost of the antenna, and the proximity sensor is not interfered by other parts of the antenna and thereby has increased sensitivity.

9 Claims, 9 Drawing Sheets

ANTENNA STRUCTURE WITH PROXIMITY SENSOR

FIELD OF THE INVENTION

The present invention relates to an antenna structure for use with portable computers or hand-held electronic devices, and more particularly to an antenna structure that has a coupled-fed antenna and a proximity sensor integrated on one circuit substrate.

BACKGROUND OF THE INVENTION

Normally, to control the amount of radiation emitted from a hand-held electronic device and absorbed by human body, a proximity sensor (i.e. P-sensor) is additionally provided in the hand-held electronic device at a position of a primary antenna for wireless wide-area network (WWAN) for sensing the approach of a human body to the hand-held electronic device and accordingly actuating a power-reduction protection mechanism to lower the amount of radiation emitted from the device. Further, to ensure accurate sensing of approach, usually two proximity sensors are used by most electronic device manufacturers in their device designs to achieve the purpose of radiation protection.

Please refer to FIGS. 1 and 2. Conventionally, a portable computer or a hand-held electronic device is provided with a primary antenna 10 and two proximity sensors 11. The primary antenna 10 and the proximity sensors 11 are separate elements and must be spaced from one another by a predetermined distance. As shown in FIG. 1, the proximity sensor 11 generally has a substantial size about 10 mm and the primary antenna 10 about 61 mm, and a space of 5 mm between the primary antenna 11 and each proximity sensor 11 is required. Therefore, a total design length as long as 91 mm is required for the primary antenna 10 and the two proximity sensors 11. However, to meet the progress in the wireless communication transmission technology, the current design size of the antenna needs to be miniaturized.

As a result, another type of antenna structure with proximity sensor has been developed. As shown in FIGS. 3 and 4, this type of antenna 20 includes a dielectric substrate 21 and a capacitive proximity sensor 22. The dielectric substrate 21 is provided on two opposite sides with a first patterned conductive layer 23 and a second patterned conductively layer 24, respectively. The first patterned conductive layer 23 and the second patterned conductive layer 24 are located correspondingly to present patterned traces of an inverted-F antenna, and two capacitors 25, 26 are connected to a signal line 27 and a ground line 28, respectively. Further, the first patterned conductive layer 23 and the second patterned conductive layer 24 are respectively coupled via an inductor 29 to the capacitive proximity sensor 22.

Since this type of antenna structure requires two patterned conductive layers, a plurality of capacitors, and a plurality of inductors to work with the proximity sensor to provide the approach sensing function, it still needs improvement in terms of antenna miniaturization.

SUMMARY OF THE INVENTION

A primary object of the present invention is to provide an improved antenna structure with proximity sensor by integrating a coupled-fed antenna and a proximity sensor on one circuit substrate, so that a part of the antenna is directly used as a capacitor electrode of the proximity sensor. Unlike the conventional antenna structure that has independent antenna and proximity sensors and requires more than one proximity sensor, the antenna structure of the present invention can have reduced volume to effectively save the room and the manufacturing cost needed by it.

Another object of the present invention is to provide an antenna structure with proximity sensor, in which a patterned conductive layer connected to the proximity sensor is not in direct contact with a ground signal line and a signal feed line, so that interference to the proximity sensor caused by other parts of the antenna is reduced, enabling the proximity sensor to have effectively increased sensitivity.

To achieve the above and other objects, the antenna structure with proximity sensor according to the present invention is electrically connected via a transmission line to at least one transceiver circuit to together form a wireless communication circuit in an electronic device. The transmission line includes a signal feed line and a ground signal line.

The antenna structure with proximity sensor according to the present invention includes a patterned conductive layer, a proximity sensor, a capacitor and a dielectric layer.

In a first preferred embodiment of the present invention, the patterned conductive layer includes a first conductive layer and a second conductive layer, which together form a coupled-fed antenna. The first conductive layer includes a first feed terminal for electrically connecting to the signal feed line, and the second conductive layer includes a second feed terminal for electrically connecting to the ground signal line.

The proximity sensor has a peripheral circuit electrically connected to the second conductive layer and a capacitance to digital circuit electrically connected to the peripheral circuit. The capacitor is located between the second feed terminal and the ground signal line. The dielectric layer has a first side and an opposite second side; and the patterned conductive layer, the proximity sensor and the capacitor all are located on the first side of the dielectric layer.

In the first preferred embodiment, the first conductive layer includes a first radiation section and a feeder section that forms the first feed terminal, and the second conductive layer includes a second radiation section that is parallel to the first radiation section and a branch section that forms the second feed terminal. The peripheral circuit of the proximity sensor is electrically connected to the branch section, and the dielectric layer can be a dielectric substrate independently provided in the electronic device or be directly formed of a protective case of the electronic device.

In a second preferred embodiment of the present invention, the patterned conductive layer includes a first conductive layer and a second conductive layer, which together form a coupled-fed antenna; and the first conductive layer includes a first feed terminal for electrically connecting to the signal feed line.

The proximity sensor has a peripheral circuit electrically connected to the second conductive layer and a capacitance to digital circuit electrically connected to the peripheral circuit. The capacitor is located between the peripheral circuit and the ground signal line. The dielectric layer has a first side and an opposite second side, and the patterned conductive layer, the proximity sensor and the capacitor all being located on the first side of the dielectric layer.

In the second embodiment, the first conductive layer includes a first radiation section and a feeder section that forms the first feed terminal, and the second conductive layer includes a second radiation section that is parallel to the first radiation section and a branch section that is electrically connected to the peripheral circuit. Similarly, the dielectric layer can be a dielectric substrate independently provided in the electronic device or be directly formed of a protective case of the electronic device.

While the two preferred embodiments are different in their structure, they operate in the same principle. When the antenna structure of the present invention operates at a first frequency, the capacitor has a high impedance value to form an open circuit, so that the second conductive layer is used as the capacitor electrode of the proximity sensor. On the other hand, when the antenna structure operates at a second frequency, the capacitor has a low impedance value to form a short circuit, so that the second conductive layer and the first conductive layer act together to form a radiation conductor of the coupled-fed antenna. Wherein, the first frequency is less than 1 MHz and the second frequency is higher than 700 MHz.

The present invention is characterized by integrating the coupled-fed antenna and the proximity sensor on the same one circuit substrate to overcome the problem in the conventional antenna structure as having independently provided antenna and proximity sensors to prevent the antenna structure from having a further reduced volume. Thus, the present invention effectively reduces the room and the manufacturing cost needed by the antenna structure. Moreover, through the design of the capacitor and the coupling patterned conductive layer, the patterned conductive layer connected to the proximity sensor is not in direct contact with the ground signal line and the signal feed line, so that interference to the proximity sensor caused by other parts of the antenna is reduced, enabling the proximity sensor to have effectively increased sensitivity.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein FIG. 1 schematically shows the installation of an antenna and two proximity sensors in an electronic device according to a first conventional way.

DETAILED DESCRIPTION OF THE PREFERRED EMBODIMENTS

Figure 1:
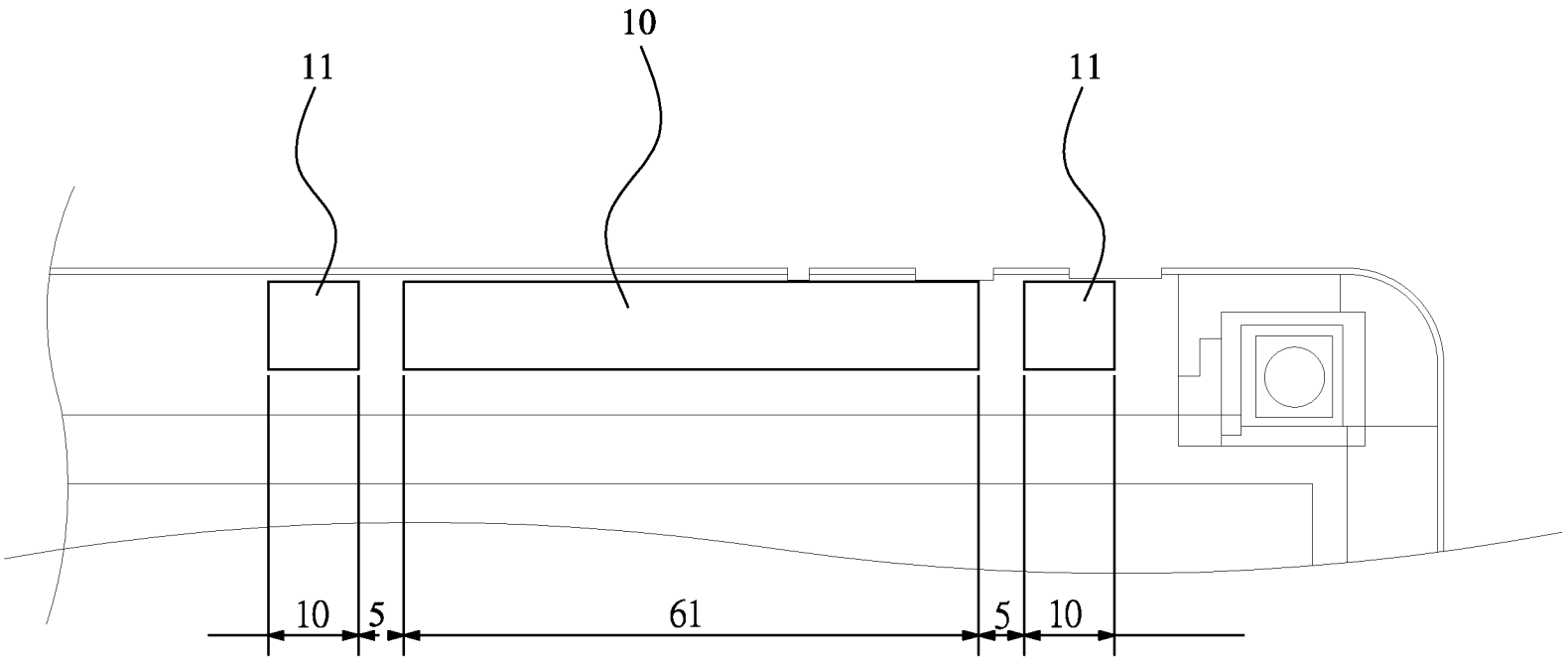
FIG. 1 (Prior Art)
Figure 2:
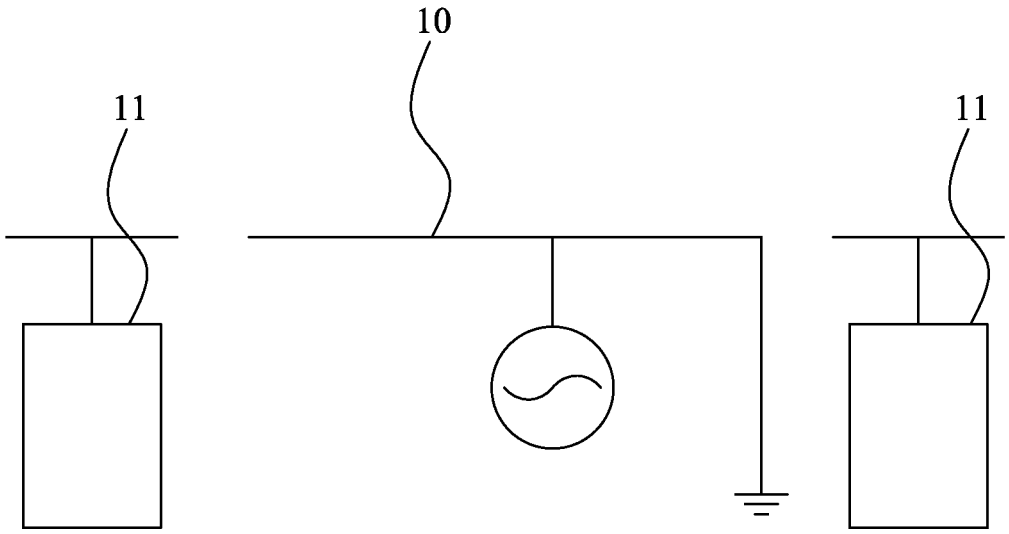
FIG. 2 (Prior Art)
FIG. 2 is a circuit diagram of the antenna and proximity sensors arrangement shown in FIG. 1.
Figure 3:
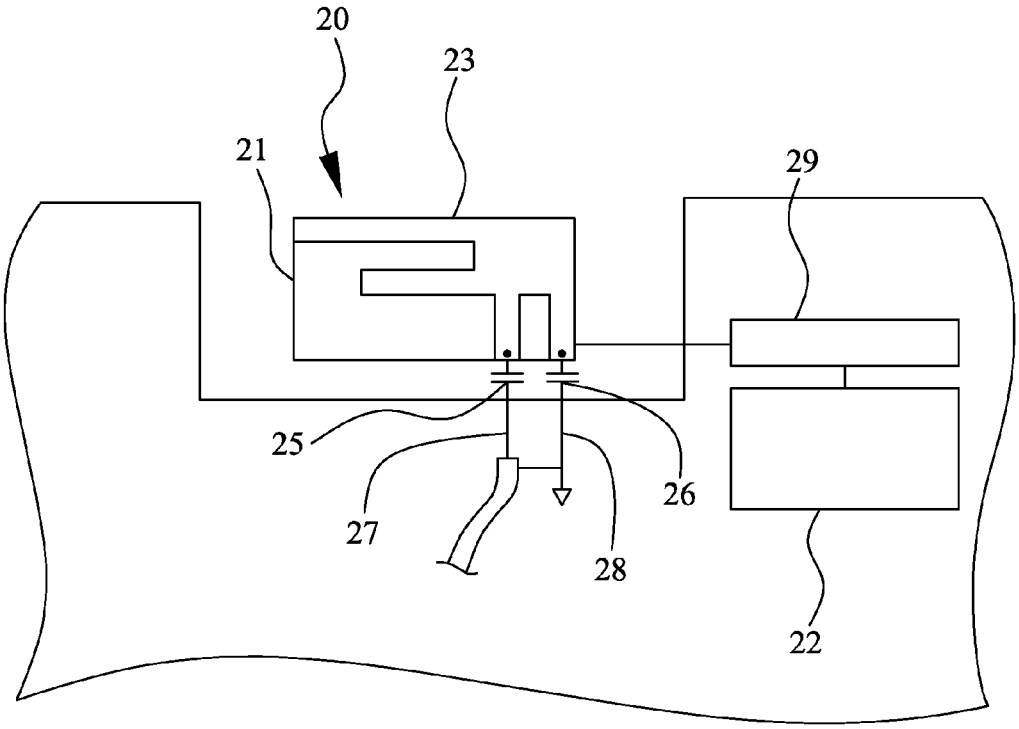
FIG. 3 (Prior Art)
FIG. 3 schematically shows the integration of an antenna structure and a proximity sensor in an electronic device according to a second conventional way.
Figure 4:
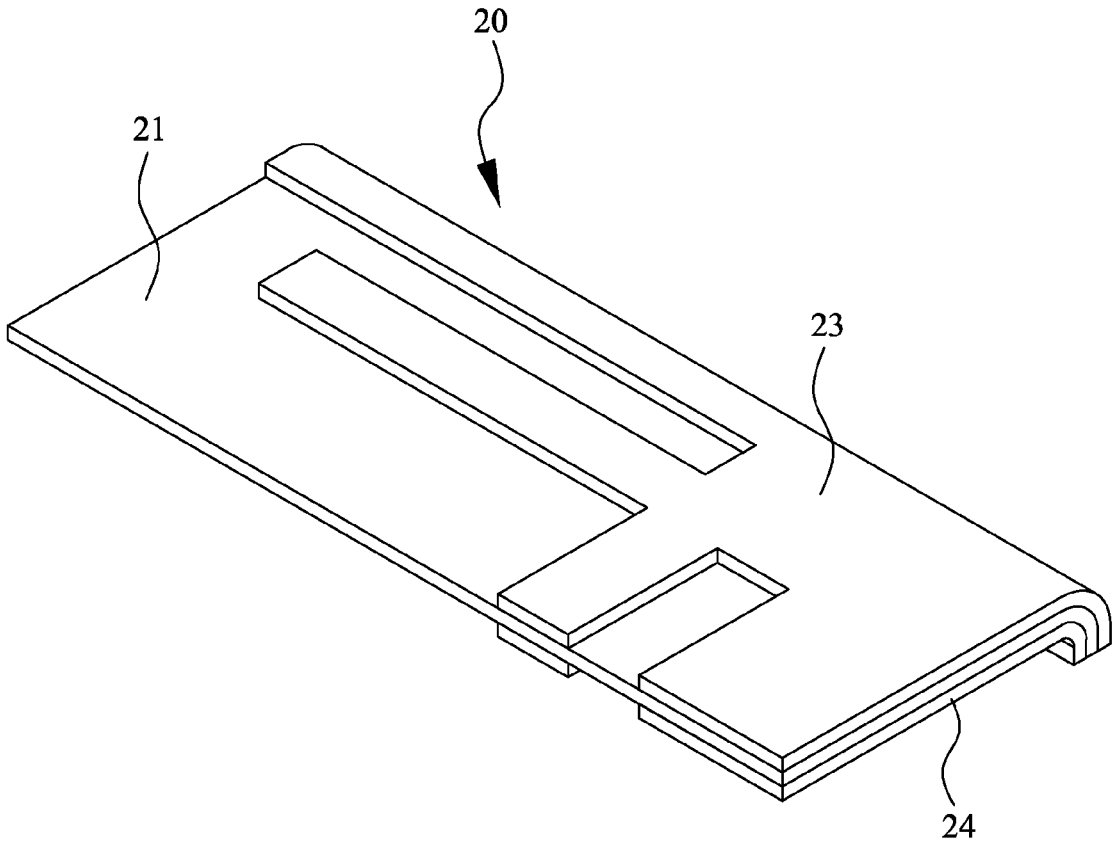
FIG. 4 (Prior Art)
FIG. 4 is a perspective view of the antenna structure shown in FIG. 3.

The present invention will now be described with some preferred embodiments thereof and with reference to the accompanying drawings. For the purpose of easy to understand, elements that are the same in the preferred embodiments are denoted by the same reference numerals.

Figure 5:
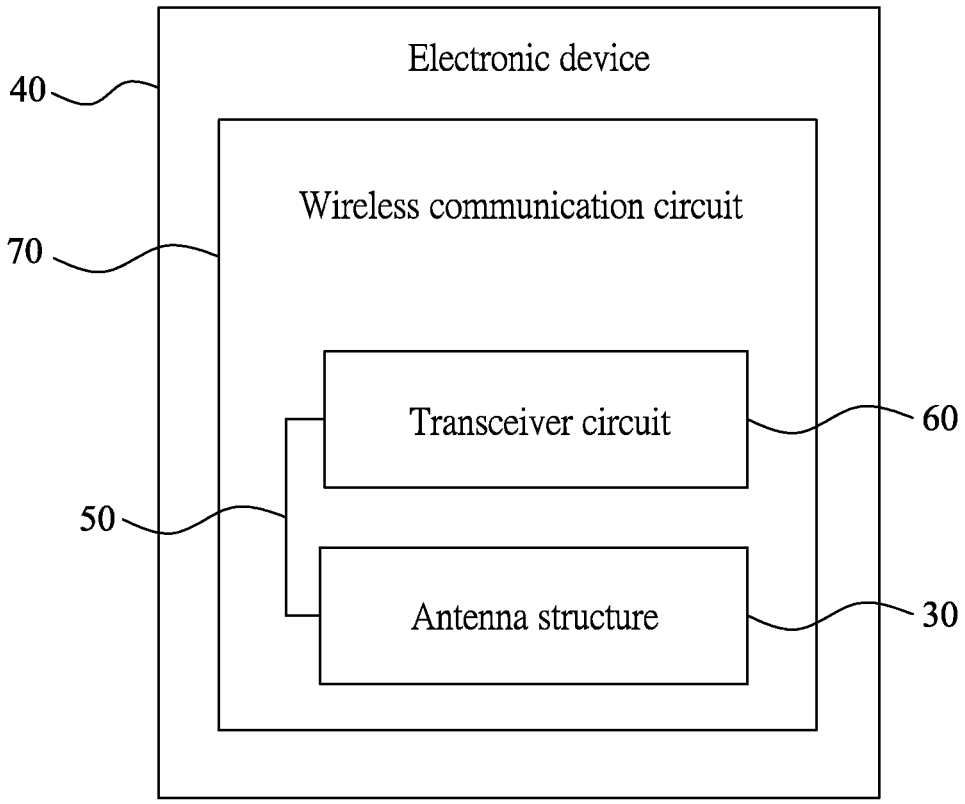
FIG. 5 is a block diagram of a wireless communication circuit provided in an electronic device, in which an antenna structure according to the present invention is mounted.

The present invention provides an antenna structure with proximity sensor, which is also briefly referred to as the antenna structure and generally denoted by reference numeral 30 herein. Please refer to FIG. 5. The antenna structure 30 according to the present invention is mounted in an electronic device 40 and is connected via a transmission line 50 to at least one transceiver circuit 60. The antenna structure 30 and the transceiver circuit 60 work together and thereby form a wireless communication circuit 70 to serve as a transmission means.

The electronic device 40 can be a desktop computer, a portable computer, such as a notebook computer or a tablet computer, a game player, a music player, a remote control set, a global positioning system (GPS) device, or a handheld or wearable device, such as a mobile phone, a watch, a pair of glasses, a headphone and other pendants that are small in size.

The transmission line 50 can be a coaxial cable, a microstrip transmission line, or a strip transmission line. Wherein, the transmission line 50 includes a signal feed line 51 and a ground signal line 52, as can be seen in FIG. 6.

The transceiver circuit 60 of the wireless communication circuit 70 may include several communication bands for processing multiple radio frequencies, such as WiFi communication 2.4 GHz and 5 GHz bands and Bluetooth communication 2.4 GHz band, or for processing cellular phone communication bands, such as 850 MHz, 900 MHz, 1800 MHz and 1900 MHz GSM bands and 2100 MHz data band. In addition, the transceiver circuit 60 may also include radio circuit and paging circuit for radio signals and television signals.

Figure 6:
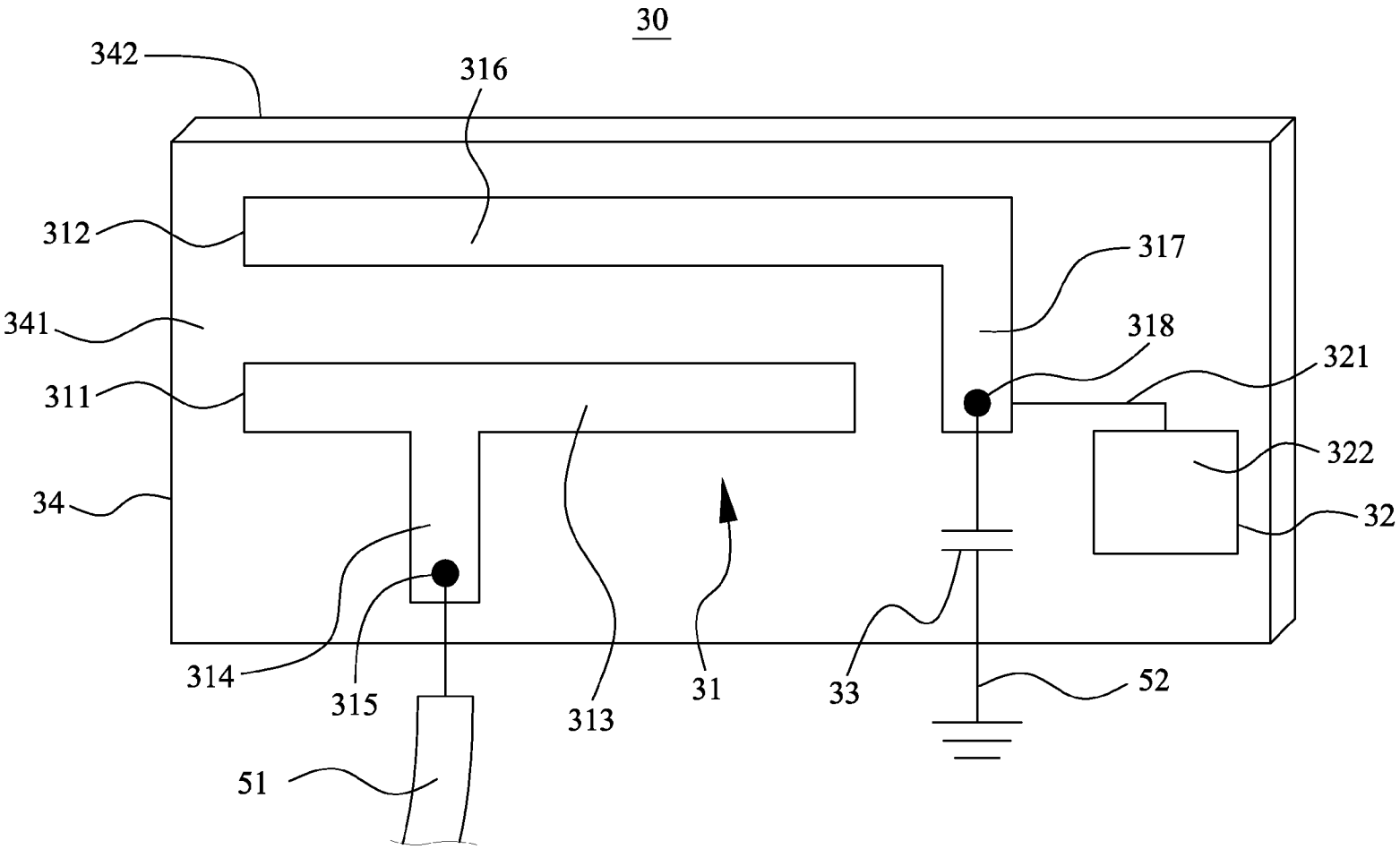
FIG. 6 is a schematic view of an antenna structure according to a first preferred embodiment of the present invention.

Please refer to FIG. 6 that is a schematic view of the antenna structure 30 according to a first preferred embodiment of the present invention. As shown, the antenna structure 30 in the first preferred embodiment includes a patterned conductive layer 31, a proximity sensor 32, a capacitor 33 and a dielectric layer 34. The patterned conductive layer 31 includes a first conductive layer 311 and a second conductive layer 312, which together form a coupled-fed antenna. The first conductive layer 311 includes a first radiation section 313 and a feeder section 314, and the feeder section 314 forms a first feed terminal 315 for electrically connecting to the signal feed line 51. The second conductive layer 312 includes a second radiation section 316, which is parallel to the first radiation section 313, and a branch section 317, which forms a second feed terminal 318 for electrically connecting to the ground signal line 52.

The proximity sensor 32 has a peripheral circuit 321 electrically connected to the second conductive layer 312, and a capacitance to digital circuit 322 electrically connected to the peripheral circuit 321. As shown in FIG. 6, the peripheral circuit 321 of the proximity sensor 32 is directly electrically connected to the branch section 317 of the second conductive layer 312.

The capacitor 33 is located between the second feed terminal 318 and the ground signal line 52. The dielectric layer 34 has a first side 341 and an opposite second side 342. The patterned conductive layer 31, the proximity sensor 32 and the capacitor 33 all are located on the first side 341 of the dielectric layer 34. In the illustrated first preferred embodiment, the dielectric layer 34 is shown as a dielectric substrate independently provided in the electronic device 40.

Figure 7:
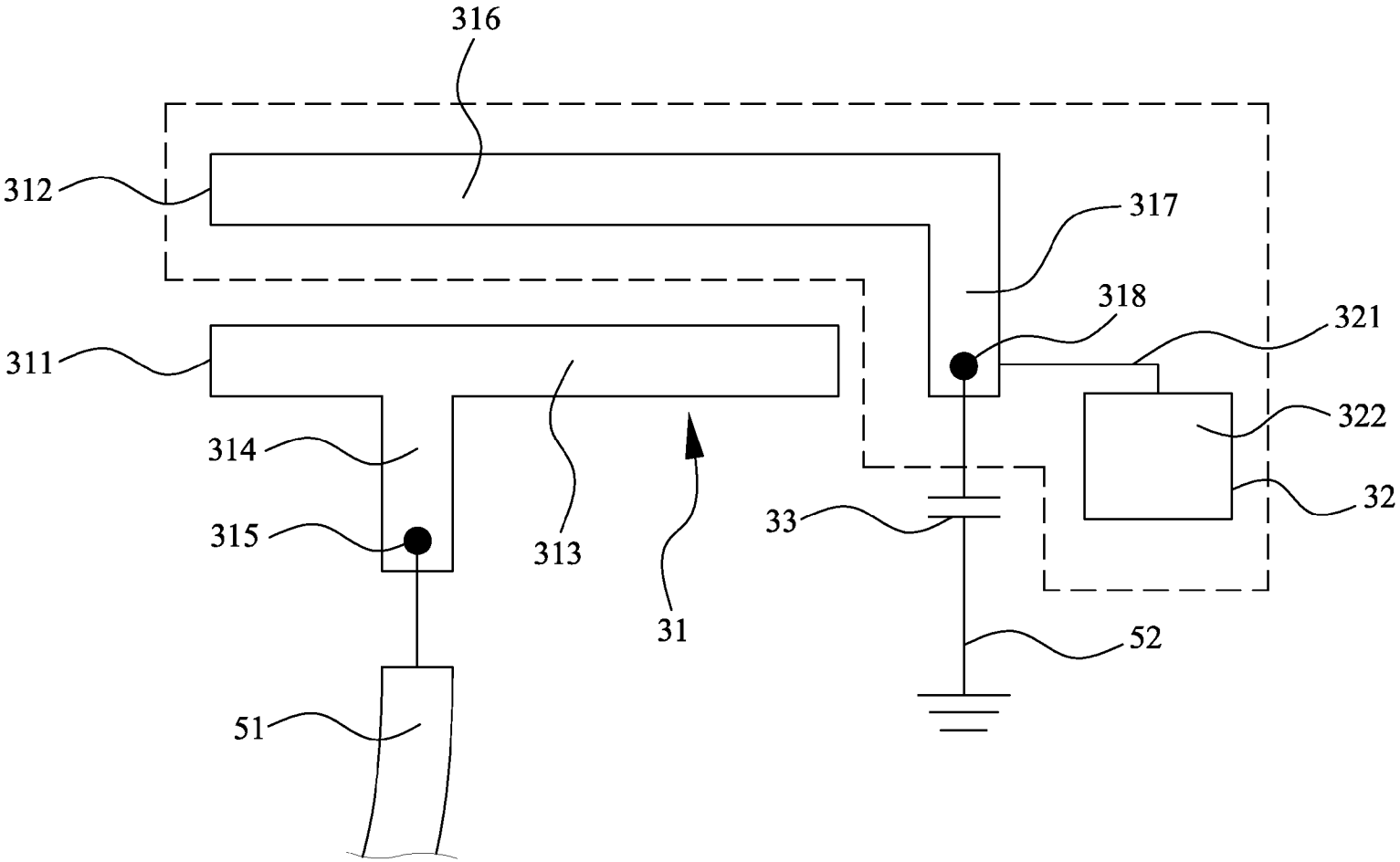
FIG. 7 shows the antenna structure according to the first preferred embodiment of the present invention in a low-frequency state with a capacitor thereof acting like an open circuit.

Please refer to FIG. 7. When the antenna structure 30 of the present invention operates at a first frequency less than 1 MHz, which is a relatively low frequency, the capacitor 33 has a high impedance value equivalent to an open circuit, bringing the proximity sensor 32 to directly use the second conductive layer 312 as a capacitor electrode, as indicated by the area framed by the broken line. At this point, there is no action between the first conductive layer 311 and the second conductive layer 312.

Figure 8:
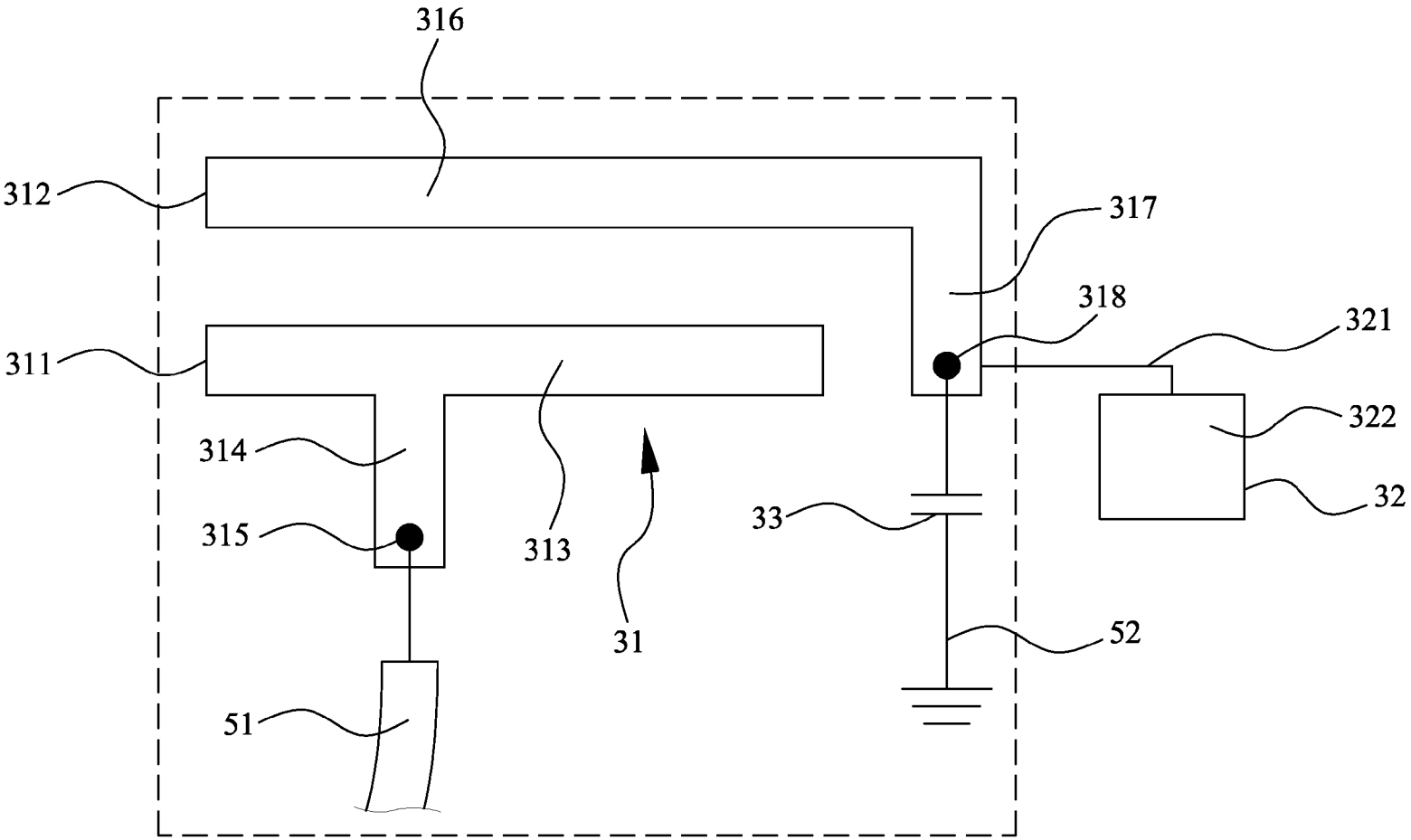
FIG. 8 shows the antenna structure according to the first preferred embodiment of the present invention in a high-frequency state with the capacitor thereof acting like a short circuit.

Please refer to FIG. 8. When the antenna structure 30 of the present invention operates at a second frequency higher than 700 MHz, which is a relatively high frequency, the capacitor 33 has a low impedance value equivalent to a short circuit, bringing the second conductive layer 312 and the first conductive layer 311 to act together and form a radiation conductor of a coupling antenna.

In the present invention, the coupled-fed patterned conductive layer 31 and the proximity sensor 32 are integrated on the same circuit substrate, allowing a part of the antenna structure 30 to be directly used as the capacitor electrode of the proximity sensor 32. Therefore, changes in the measured capacitance value will reflect and determine whether an external object is located in the proximity of the antenna structure 30.

When the proximity sensor 32 does not detect any external object that is in the proximity of the antenna structure 30, the power of the transmission radio frequency (RF) signal adopted by the electronic device 40 will not be restricted. However, when the proximity sensor 32 detects there is an external object in the proximity of the antenna structure 30, the transmission RF signal power will be lowered to reduce the near-field electromagnetic radiation intensity, so that the electronic device 40 being operated by a user at a close distance from the device can have an RF signal power in compliance with the restrictions specified by the current related codes.

Figure 9:
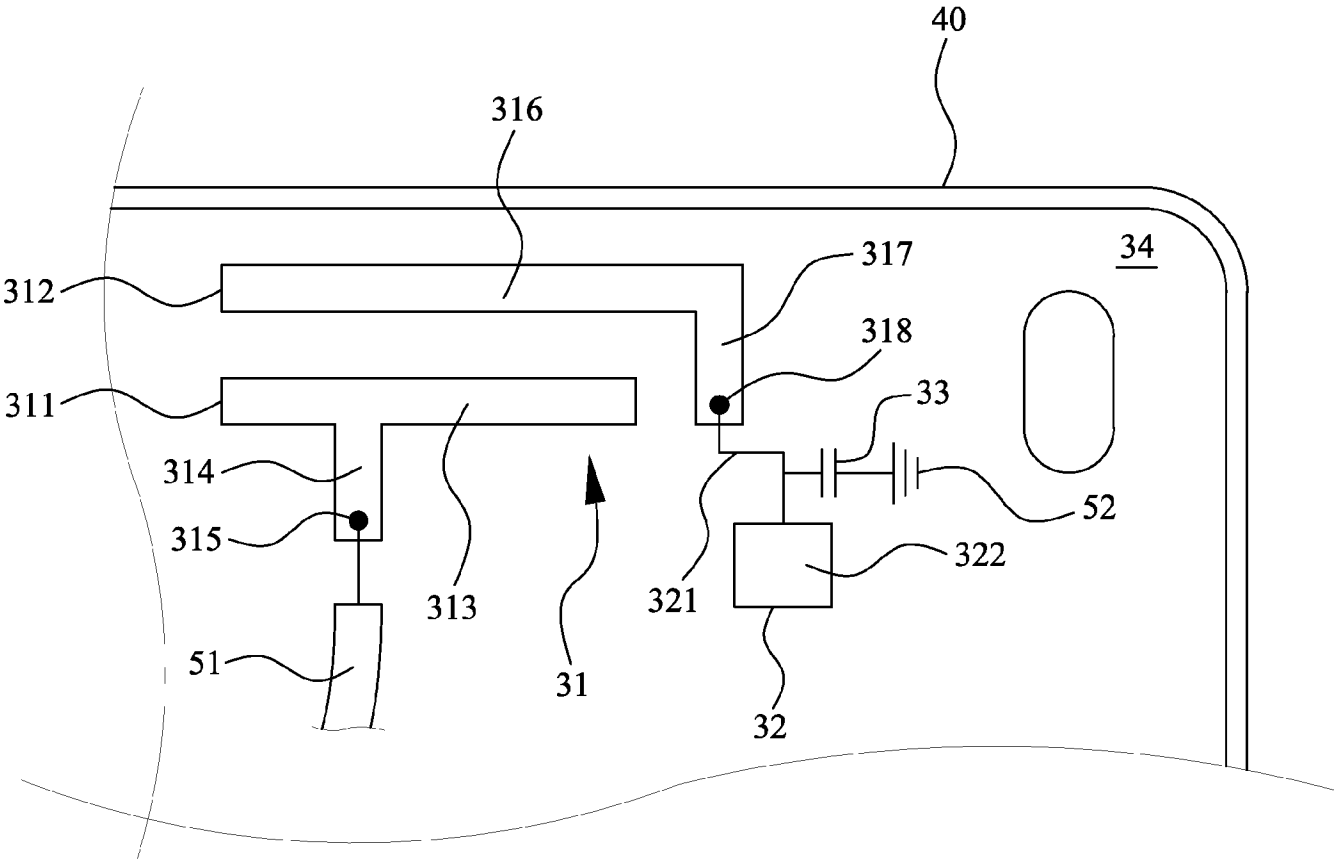
FIG. 9 is a schematic view of an antenna structure according to a second preferred embodiment of the present invention.

FIG. 9 is a schematic view of an antenna structure 30 according to a second preferred embodiment of the present invention. The antenna structure 30 in the second embodiment similarly includes a patterned conductive layer 31, a proximity sensor 32, a capacitor 33 and a dielectric layer 34. The patterned conductive layer 31 includes a first conductive layer 311 and a second conductive layer 312, which together form a coupled-fed antenna. The first conductive layer 311 includes a first radiation section 313 and a feeder section 314, and the feeder section 314 forms a first feed terminal 315 for electrically connecting to the signal feed line 51. The second conductive layer 312 includes a second radiation section 316, which is parallel to the first radiation section 313, and a branch section 317.

The proximity sensor 32 has a peripheral circuit 321 electrically connected to the second conductive layer 312, and a capacitance to digital circuit 322 electrically connected to the peripheral circuit 321. As shown in FIG. 9, the peripheral circuit 321 of the proximity sensor 32 is electrically connected to the branch section 317 of the second conductive layer 312 and the ground signal line 52 of the transmission line 50.

The capacitor 33 is located between the peripheral circuit 321 and the ground signal line 52. The dielectric layer 34 has a first side 341 and an opposite second side 342. The patterned conductive layer 31, the proximity sensor 32 and the capacitor 33 all are located on the first side 341 of the dielectric layer 34. In the illustrated second preferred embodiment, the dielectric layer 34 serves as a part of a protective case of the electronic device 40.

The second preferred embodiment is different from the first preferred embodiment in that, in the second embodiment, the ground signal line 52 is electrically connected to the capacitor 33 and the peripheral circuit 321. However, the difference in the circuit design between the first and the second preferred embodiment would not have any adverse influence on the operation of the antenna structure 30. In the second embodiment, when the antenna structure 30 operates at the first frequency less than 1 MHz, the capacitor 33 similarly has a high impedance value equivalent to an open circuit, bringing the proximity sensor 32 to directly use the second conductive layer 312 as a capacitor electrode. On the other hand, when the antenna structure 30 operates at the second frequency higher than 700 MHz, the capacitor 33 similarly has a low impedance value equivalent to a short circuit, bringing the second conductive layer 312 and the first conductive layer 311 to act together and form a radiation conductor of a coupling antenna.

The present invention has been described with some preferred embodiments thereof and it is understood that many changes and modifications in the described embodiments can be carried out without departing from the scope and the spirit of the invention that is intended to be limited only by the appended claims.

What is claimed is:

1. An antenna structure with proximity sensor, being connected via a transmission line to at least one transceiver circuit to together form a wireless communication circuit in an electronic device, and the transmission line including a signal feed line and a ground signal line, comprising:

a patterned conductive layer including a first conductive layer and a second conductive layer, which together form a coupled-fed antenna; the first conductive layer including a first feed terminal for electrically connecting to the signal feed line, and the second conductive layer including a second feed terminal for electrically connecting to the ground signal line, wherein the signal feed line is directly connected to the first feed terminal;

a proximity sensor having a peripheral circuit electrically connected to the second conductive layer and a capacitance to digital circuit electrically connected to the peripheral circuit;

a capacitor located between the second feed terminal and the ground signal line; and a dielectric layer having a first side and an opposite second side; and the patterned conductive layer, the proximity sensor and the capacitor all being located on the first side of the dielectric layer;

wherein when the antenna structure operates at a first frequency, the capacitor has a high impedance value to form an open circuit, so that the second conductive layer is used as a capacitor electrode of the proximity sensor and there is no action between the first conductive layer and the second conductive layer; and wherein when the antenna structure operates at a second frequency, the capacitor has a low impedance value to form a short circuit, so that the second conductive layer and the first conductive layer act together to form a radiation conductor of a coupling antenna.

2. The antenna structure with proximity sensor as claimed in claim 1, wherein the dielectric layer is selected from the group consisting of an independent dielectric substrate and a protective case of the electronic device.

3. The antenna structure with proximity sensor as claimed in claim 1, wherein the first conductive layer includes a first radiation section and a feeder section that forms the first feed terminal, and the second conductive layer includes a second radiation section that is parallel to the first radiation section and a branch section that forms the second feed terminal.

4. The antenna structure with proximity sensor as claimed in claim 3, wherein the peripheral circuit of the proximity sensor is electrically connected to the branch section.

5. The antenna structure with proximity sensor as claimed in claim 1, wherein the first frequency is less than 1 MHz, and the second frequency is higher than 700 MHz.

6. An antenna structure with proximity sensor, being connected via a transmission line to at least one transceiver circuit to together form a wireless communication circuit in an electronic device, and the transmission line including a signal feed line and a ground signal line, comprising:

a patterned conductive layer including a first conductive layer and a second conductive layer, which together form a coupled-fed antenna; and the first conductive layer including a first feed terminal for electrically connecting to the signal feed line, wherein the signal feed line is directly connected to the first feed terminal;

a proximity sensor having a peripheral circuit electrically connected to the second conductive layer and a capacitance to digital circuit electrically connected to the peripheral circuit;

a capacitor located between the peripheral circuit and the ground signal line; and a dielectric layer having a first side and an opposite second side; and the patterned conductive layer, the proximity sensor and the capacitor all being located on the first side of the dielectric layer;

wherein when the antenna structure operates at a first frequency, the capacitor has a high impedance value to form an open circuit, so that the second conductive layer is used as a capacitor electrode of the proximity sensor and there is no action between the first conductive layer and the second conductive layer; and wherein when the antenna structure operates at a second frequency, the capacitor has a low impedance value to form a short circuit, so that the second conductive layer and the first conductive layer act together to form a radiation conductor of a coupling antenna.

7. The antenna structure with proximity sensor as claimed in claim 6, wherein the dielectric layer is selected from the group consisting of an independent dielectric substrate and a protective case of the electronic device.

8. The antenna structure with proximity sensor as claimed in claim 6, wherein the first conductive layer includes a first radiation section and a feeder section that forms the first feed terminal, and the second conductive layer includes a second radiation section that is parallel to the first radiation section and a branch section that is electrically connected to the peripheral circuit.

9. The antenna structure with proximity sensor as claimed in claim 6, wherein the first frequency is less than 1 MHz, and the second frequency is higher than 700 MHz.

* * * * *